United States Patent [19]

Heuckroth

[11] 4,111,380

[45] Sep. 5, 1978

[54] WELDING WIRE SPOOL SHROUD

[76] Inventor: Carl C. Heuckroth, 101 Hemlock Dr., Lodi, Ohio 44254

[21] Appl. No.: 806,412

[22] Filed: Jun. 14, 1977

[51] Int. Cl.[2] ..... B65H 49/00

[52] U.S. Cl. ..... 242/128; 242/137

[58] Field of Search ..... 242/128, 129, 137, 137.1, 242/129.8; 219/9.5, 58, 130

[56] References Cited

U.S. PATENT DOCUMENTS

| | | | |
|---|---|---|---|
| 2,349,237 | 5/1944 | Bouhuys et al. | 242/137.1 |
| 2,681,401 | 6/1954 | Anderson | 219/130 |
| 3,648,947 | 3/1972 | Shelton | 242/128 |

*Primary Examiner*—Leonard D. Christian

*Attorney, Agent, or Firm*—Reising, Ethington, Barnard, Perry & Brooks

[57] ABSTRACT

A transparent and flexible protective shroud for a welding wire containing spool adapted to be detachably mounted on a wire pay out assembly.

3 Claims, 3 Drawing Figures

WELDING WIRE SPOOL SHROUD

The present invention relates to a welding wire storage and feed system which is enclosed in such a way as to prevent damage to the welding wire as it is fed off of a spool and also to prevent injury to personnel working in the vicinity of the welding wire. More specifically, the invention relates to the use of an upright spool of welding wire which is adapted to be uncoiled from the spool and fed to an electric welding gun.

Heretofore such spools of welding wire, when operatively connected to the welding gun, have normally been left in an unprotected condition on the floor of a factory. A typical environment in which such spools of welding wire are used is on assembly lines where the welding wire can gather dirt or otherwise be damaged through the inadvertent contact by personnel or other equipment. At such time as the electric welding gun is being operated and the wire fed from the spool, the wire and the spool have an electric charge thereon and an inadvertent grounding of the wire can cause damage thereto or a considerable shock to an individual causing such grounding. On other occasions, the welding wire can be advertently or inadvertently cut or bent so as to put the welding gun out of operation until the cut or deformed wire is repaired. In other cases, and where the welding wire spool is exposed to dirt and grease, operation of the wire feed mechanism can be disrupted causing the feed rate of the welding wire to be varied resulting in either defective or improper welding.

PRESENT INVENTION

The present invention is directed to a system for shrouding a welding wire spool and feed system in such a way as to protect the welding wire from damage or fouling and personnel from injury. At the same time, the shrouding device for the subject invention is made of a transparent material which permits the operator to visually inspect the quantity of wire left on the spool and thereby avoid a run-out of wire and consequent need to refeed wire through the system. The shroud also includes closure means to permit ready access to the welding wire on the spool if necessary. By making the transparent shroud of a flexible material, such as heavy-duty polyethylene, the shroud and wire feed mechanism may be easily detached from the welding wire spool at such time as replacement of the spool is necessary. The flexible character of the shroud also facilitates its being collapsed for storage or shipping.

The details of the invention will be apparent from the drawings and description which follows.

Figure 1:
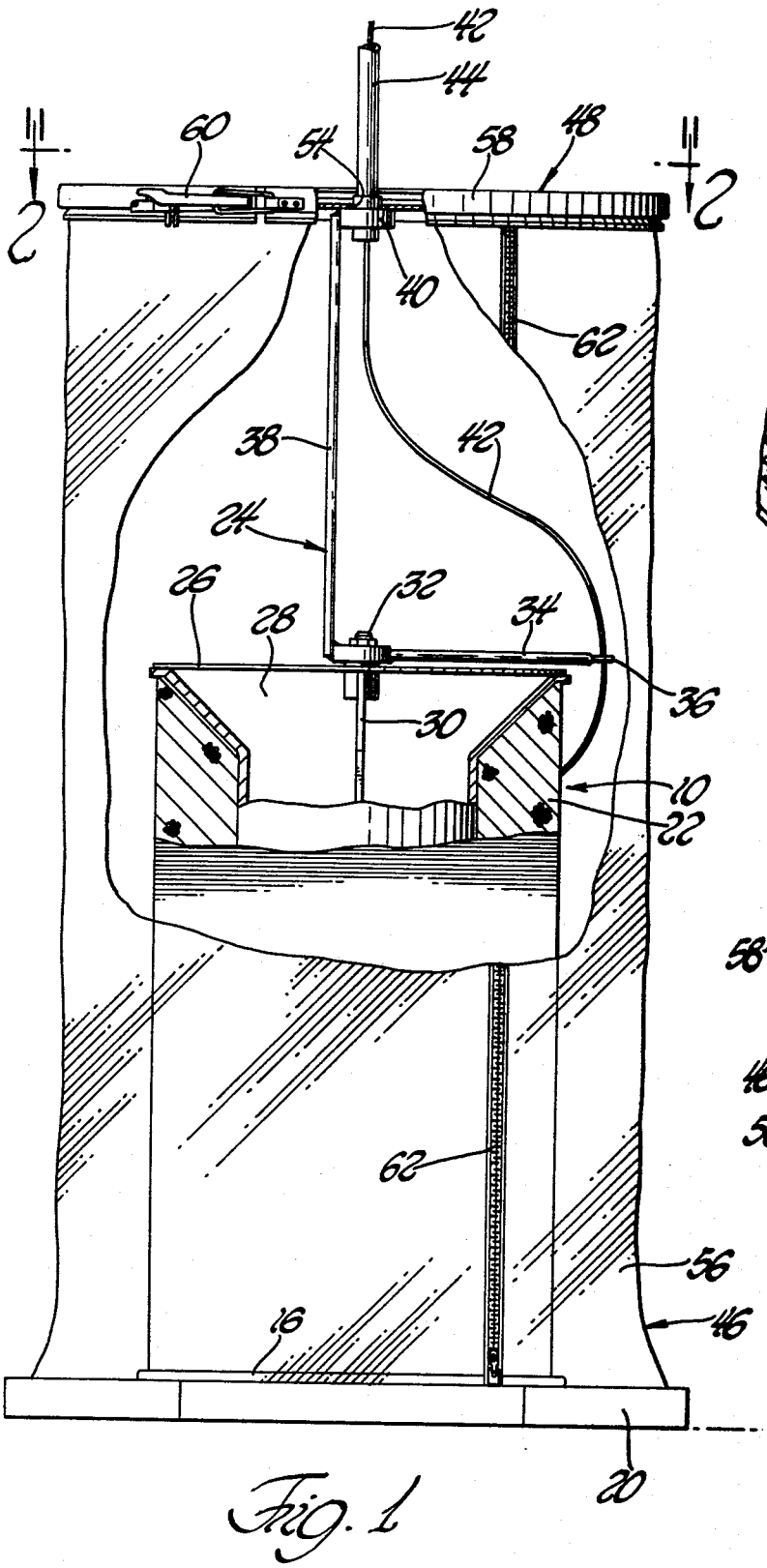
FIG. 1 is a partially sectioned elevational view of the welding wire spool shrouding system.
Figure 2:
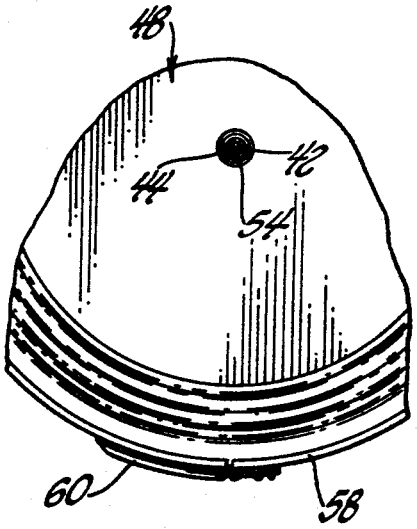
FIG. 2 is a fragmentary plan view along line 2—2 of FIG. 1.

Referring to FIG. 1 of the drawings, a spool is indicated generally at 10 and includes an upright cylindrical section 12 having circular flange portions 14 and 16 formed at the respective ends thereof. If desired, the flange portions 14 and 16 may connect with cylindrical portion 12 through intermediate flared conical portions 18. As seen in the drawing, spool 16 is adapted to be positioned in an upright fashion and supported upon flange 16. For ease of manual lifting and transporting spool 16 about the factory, as described in my copending application Ser. No. 806,413 filed June 14, 1977, it is normally mounted upon a platform member 20.

A multi-layered coil of welding wire 22 is wrapped about cylindrical spool portion 12 and is contained between flanges 14 and 16.

In order to unreel and feed the welding wire from spool 10, a wire pay-off device, indicated generally at 24, is supported upon the open end of said spool. The wire pay-off device is of the general type shown in U.S. Pat. No. 3,648,947 Shelton. Device 24 is comprised of a circular plate 26 having depending and perpendicularly related reinforcing legs or panels 28 and 30. A threaded stud or bolt 32 projects upwardly from the center of circular plate 26 and is adapted to rotatably support an orbit arm 34 thereon. The outer end of orbit arm 34 includes an eyelet or wire guide 36. An upright leg 38 is fixed to the inner end of orbit arm 34 and has a second wire guide 40 fixed thereto in coaxially spaced relation to the threaded pin 32.

As best seen in FIG. 1, wire pay-off device 24 is simple loosely supported in the upper open end of spool 10 after which a strand of wire 42 is unwrapped and threaded through the first wire guide means 36 so as to pass upwardly through the second wire guide 40. As wire 42 is drawn upwardly by a conventional wire drive mechanism, not shown, the orbit arm 34 rotates around the spool so as to cause a smooth uncoiling of the wire therefrom. A flexible conduit 44 is secured to the second wire guide means 40 whereby the welding wire is shielded as it is fed from spool 10 to a suitable welding gun, not shown.

Figure 3:
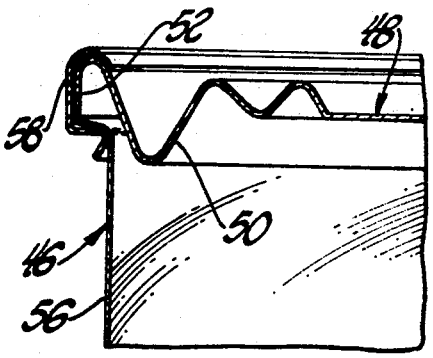
FIG. 3 is a fragmentary cross-section of the upper left corner of FIG. 1.

To protect the welding wire from being fouled or otherwise damaged and to guard against personnel injury, a protective shroud device is utilized and indicated generally at 46 in FIGS. 1 and 3.

Shroud device 46 includes a rigid upper end plate 48 having a reinforcing rib 50 radially proximate to a downwardly projecting circumferential flange 52 which is generally perpendicular to the plane of the end plate. A central opening 54 is formed in end plate 48 such that a portion of the second wire guide element 40 can project therethrough whereby the end plate is supported upon the wire pay-off device 24 in vertically spaced relation to spool 10.

Shroud device 46 also includes a tubular skirt member 56 formed of a transparent plastic material such as a heavy-duty polyethylene. The diameter of tubular skirt 56 is substantially the same as that of end plate 48 and is adpated to be snugly fitted around end plate flange 52. A locking band 58 having a suitable releasable clamping member 60 is adapted to fit around the upper end of tubular skirt member 56 and clamp the same against end plate flange 52. The other end of tubular skirt 56 is open and is adapted to pass over spool 10 and hang freely from end plate 48 when supported upon wire pay-off device 24.

Being transparent, the operator is able to view the wire containing spool through shroud skirt 56 and determine when replacement of the spool is necessary. In order to permit easy access to wire containing spool 10 for servicing or other reasons, a closure device such as zipper 62 is provided on shroud skirt 56. Zipper 62 extends throughout the length of the shroud from adjacent end plate 48 to the open bottom end thereof. Thus, ready access to the spool and welding wire is possible without removal of the shroud device.

It is apparent that other modifications are possible within the intended scope of the invention as set forth in the hereinafter appended claims.

What is claimed is:

1. An enclosed welding wire storage and feed system comprising a spool having an upright hollow cylindrical section, a pair of axially spaced, radially outwardly extending, circular flange members disposed at the respective ends of said cylindrical section, a multi-layered coil of welding wire wrapped about the cylindrical spool section and contained between said flange members, said wire wrapped spool being supported upon one of said flange members such that the other flange is disposed vertically above said one flange, a wire pay-off device supported in the upper end of said spool proximate said other flange, said device including a rotatable orbit arm, said orbit arm having a first end extending radially beyond said other flange and terminating in a first wire guide element, a leg element projecting upwardly from the other end of said orbit arm and terminating at its upper end in a second wire guide element generally coaxially aligned with the axis of said cylindrical spool portion and spaced vertically above the upper end of said spool, a free end of wire from said coil extending through said first and second wire guides, and a non-porous protective shroud enclosing said wire pay-off device and said spool, said protective shroud being supported upon the second wire guide element of the wire pay-off device in vertically and horizontally spaced relation to said spool and said shroud including means permitting access to said spool.

2. An enclosed welding wire storage and feed system as set forth in claim 1 wherein said protective shroud includes a rigid end plate having a central opening therethrough, said end plate being supported upon the wire pay-off device such that the opening is coaxially aligned with the second wire guide, and a transparent plastic skirt secured to and depending from said rigid end plate so as to enclose said wire pay-off device and said spool.

3. An enclosed welding wire storage and feed system as set forth in claim 2 wherein said rigid end plate is circular and said skirt is of tubular form, the diameters of said plate and said skirt being larger than the diameters of said circular spool flanges, said end plate including a circumferential flange and a band adapted to circumferentially clamp one end of said tubular skirt against said end plate flange.

* * * * *